United States Patent [19]

White et al.

[11] 4,058,479

[45] Nov. 15, 1977

[54] FILTER-LINED CONTAINER FOR HAZARDOUS SOLIDS

[75] Inventors: Leslie E. White, Folsom; Charles M. Gracey, Carmichael, both of Calif.

[73] Assignee: Aerojet-General Corporation, El Monte, Calif.

[21] Appl. No.: 576,679

[22] Filed: May 12, 1975

[51] Int. Cl.[2] ..... G21F 9/36

[52] U.S. Cl. ..... 252/301.1 W; 206/524.1; 250/506; 250/507; 252/301.15

[58] Field of Search ..... 250/506, 507; 252/301.1 W; 220/65, 63 R; 206/84, 525

[56] References Cited

U.S. PATENT DOCUMENTS

| | | | |
|---|---|---|---|
| 3,185,339 | 5/1965 | Flemming | 220/65 |
| 3,739,731 | 6/1973 | Tabor | 220/63 R |
| 3,833,740 | 9/1974 | Schmidt | 206/.5 |

*Primary Examiner*—Benjamin R. Padgett

*Assistant Examiner*—Deborah L. Kyle

*Attorney, Agent, or Firm*—John S. Bell

[57] ABSTRACT

Particulate radioactive wastes are packaged for storage until radioactivity decays by fastening a tight mesh fabric bag in a barrel or other suitable storage container, filling the bag with a mixture of radioactive waste material and a non-radioactive liquid material, and then solidifying the non-radioactive liquid to encapsulate the radioactive waste. The tight mesh weave of the fabric bag acts as a barrier to the particulate radioactive material but not to the liquid. A portion of the liquid thus flows through the bag to form a protective layer between the bag and outer container wall. The remainder stays in the bag and mixes with the radioactive particulate. Solidification of the non-radioactive liquid produces a monolithic solid having a protective layer of a solidified non-radioactive material covering the entire surface area of an immobilized mass of radioactively contaminated particulate material.

10 Claims, 6 Drawing Figures

FILTER-LINED CONTAINER FOR HAZARDOUS SOLIDS

BACKGROUND OF THE INVENTION

1. Field of the Invention

The handling of toxic materials, and more particularly the packaging of low level radioactive wastes for storage until radioactivity decays.

2. Brief Description of the Prior Art

Nuclear power plants and various other facilities that handle nuclear material, such as plants for manufacturing nuclear fuels and tracers, use substantial quantities of water in the operational process for cooling machinery and for washing radioactively contaminated parts. This water picks up various minerals, salts, and other materials that become contaminated with radioactive isotopes. Water treatment apparatus is therefore used to periodically remove these contaminants from the water. The removed material is generally discharged either as a low radiation level particulate sludge or aqueous solution that is mixed with a non-radioactive encapsulation, solidification or other immobilization material and then stored in a barrel or other suitable containment container until radioactivity decays.

The immobilization material is used to prevent dispersion of the particulate radioactive material if the barrel is ruptured. Generally, either cement, ureaformaldehyde, or a petroleum organic material such as asphalt, bitumin, polyethylene or paraffin is used for immobilization. The radioactive waste particles mix evenly with the immobilization material and become uniformly dispersed both within and at the surface of the immobilizing material. Any crack or break in the outer container wall will expose a substantial quantity of radioactive material to water and other leaching agents capable of dispersing radioactive contamination, because the immobilization materials shrink slightly away from the walls of the container as they solidify. And, the entire package can be quickly destroyed because some of the immobilization materials also absorb water which causes them to swell, break apart, and thus permit dispersion of substantially all radioactive material.

SUMMARY OF THE INVENTION

This invention provides a package for storing toxic solids in which the stored solids are homogeneously dispersed in an immobilization material and also completely surrounded by a layer of the immobilization material. The immobilization material mixed with the toxic solids prevents dispersion of those solids if the package should be suddenly cracked or broken during transportation or other handling. The outer or surrounding surface area layer of immobilization material uniformly isolates the toxic material from the container wall and thereby prevents dispersion of that material by leaching of water soluble chemicals, and the like, if the outer container deteriorates during the long-term storage.

A method of forming a package for storing radioactive waste is described herein, in which a tight mesh fabric bag is inserted into a barrel or other suitable container. The bag is filled with particulate radioactive waste material and a non-radioactive liquid that mixes with the radioactive waste particles. The tight mesh of the fabric acts as a barrier to the solid waste material, but not to the liquid. The granular waste particles are thus held within the bag. A substantial quantity of liquid also stays inside the bag in mixture with the radioactive solids, filling the void spaces between particles and surrounding each particle. But, a portion of the liquid flows through the bag as it is filled to form a layer of non-radioactive material between the bag and barrel wall.

After the barrel is filled, the liquid material is solidified to provide a massive monolithic solid that contains radioactive waste immobilized by a solidification agent. The tight mesh bag is incorporated in the solidified mass by the solidification of the liquid contained internally, externally, and within the pores or weave of the tight mesh bag. It thus becomes an integral part of the overall solidified mass that adds strength and structural integrity, particularly to the outer portions of that mass. The tight mesh weave of the bag, and smaller diameter than that of the outer container, also exclude radioactive material from the layer of solidification material between the bag and outer container. This layer thus becomes a containment barrier that isolates radioactive material from the environment, and is also integral and contiguous with the material contained internal to that layer.

This surface area protective layer provides an effective barrier against leaching and dispersion of the radioactive salts and other materials. Its thickness can be easily controlled during formation of the storage package, by selection of the sizes of the bag and barrel and the positioning of the bag within the barrel, to provide an appropriate degree of protection to prevent impact or corrosion likely to rupture the outer container wall from penetrating to the radioactive material. And, any break that may occur through both the outer container wall and this protective layer will expose only a minimum quantity of radioactive material to the environment because the protective layer does not separate from the contained radioactive mixture by shrinking, or otherwise, during solidification. Thus, only the material immediately beneath any break will be exposed. And even when ruptured, the bag and surface layer provide strength that causes the contained mixture to be less susceptible to breakup by water and other leaching agents.

BRIEF DESCRIPTION OF DRAWING

The object, features, and advantages of this invention, which is defined by the appended claims, will become further apparent from a consideration of the following drawings, in which:

DETAILED DESCRIPTION OF DRAWING

Figure 1:
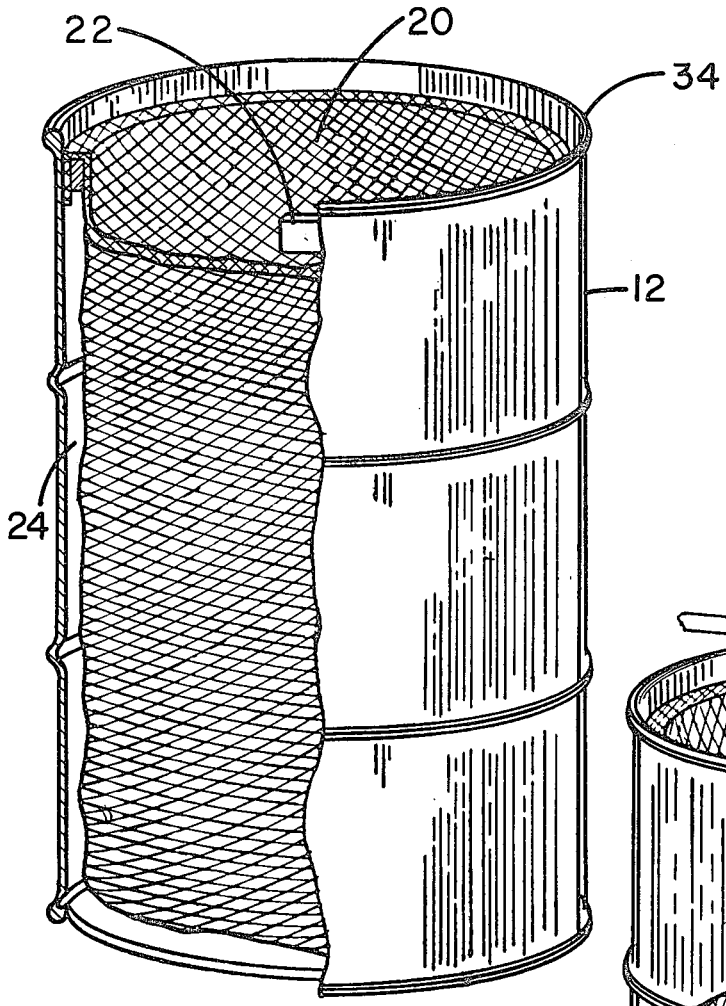
FIG. 1 is a partially cutaway, perspective illustration of a tight mesh fabric bag disposed in a barrel container.

FIGS. 1 through 5 illustrate one procedure for packaging radioactive waste for safe storage in accordance with this invention. The final waste storage package 10 formed by this procedure is probably best illustrated by FIG. 5, and comprises a barrel 12 holding particulate radioactive waste material 14 mixed with an immobilization material 16. This mixture is surrounded by a protective layer 18 that is separated from the radioactive waste mixture by a tight mesh fabric bag 20.

Figure 2:
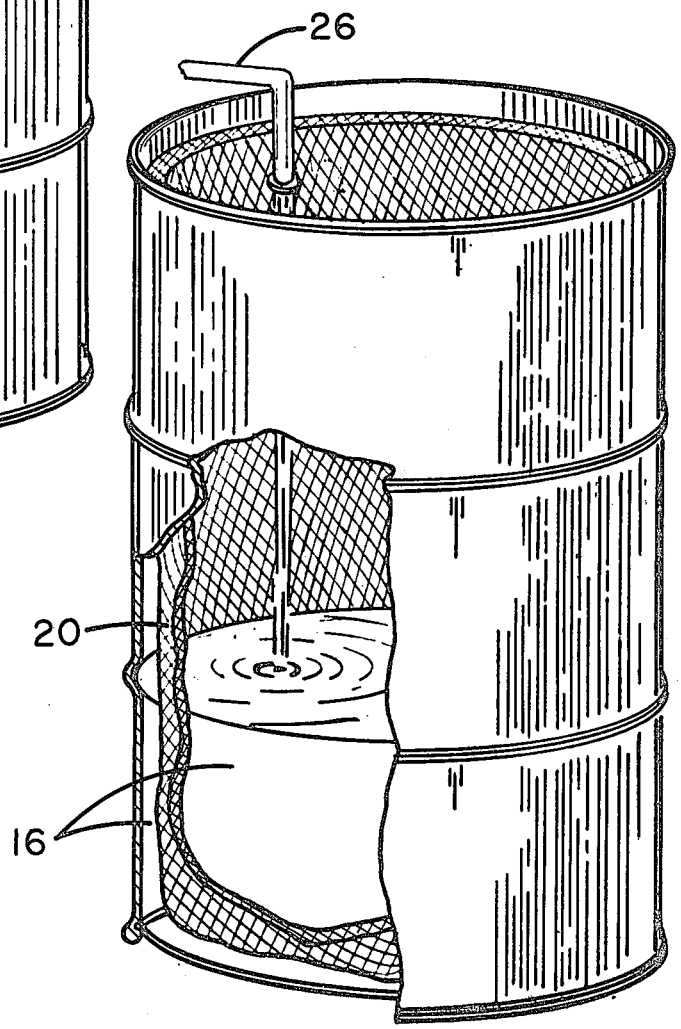
FIG. 2 shows the container of FIG. 1 about one-third filled with a non-radioactive liquid material.
Figure 3:
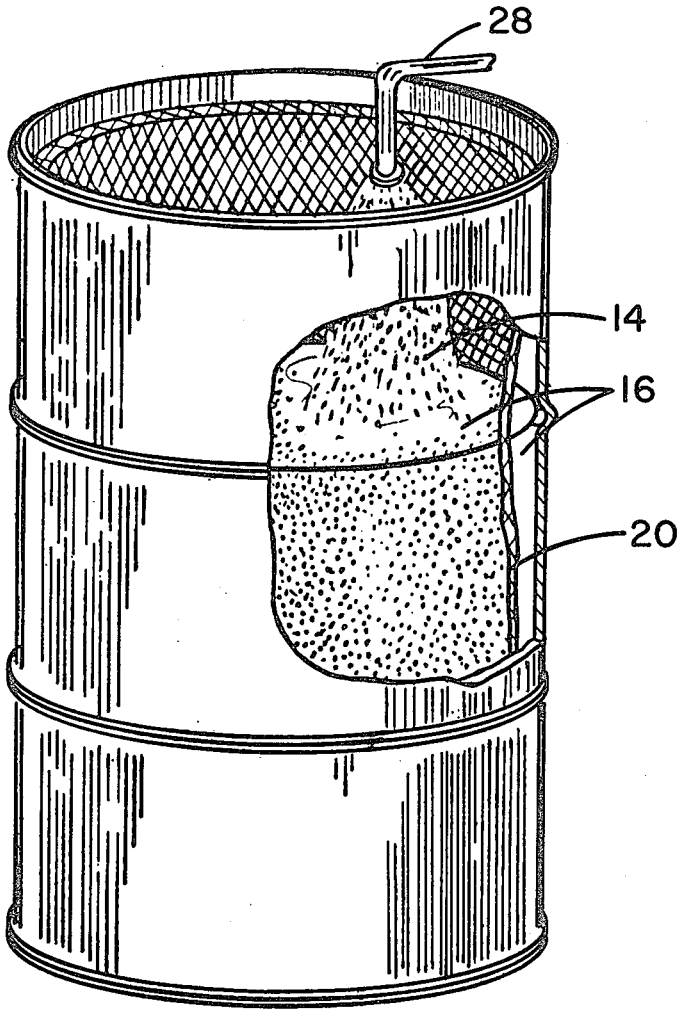
FIG. 3 shows radioactive particulate material being added and settling into the liquid material in the fabric bag.

The storage package 10 is formed by fastening the bag 20 into barrel container 12 with a snap ring 22, as illustrated in FIG. 1. The bag 20 is preshaped to match barrel 12, and slightly smaller than that barrel. When it is inserted into the barrel, it is lapped over ring 22 to leave a space 24 between bag 20 and the sides and bottom of barrel 12. The barrel 12 is then filled through pipeline 26 to a predetermined leval as illustrated in FIG. 2, with a liquid material 16 that will mix well with the radioactive material to be handled and that can be conveniently solidified for long-term storage. This liquid material should also be somewhat less dense than the radioactive material to facilitate settling of the waste into the liquid as illustrated in FIG. 3. The quantity of liquid directed into barrel 12 depends upon the liquid used and radioactive material to be stored. But, the barrel will generally be filled to between about one-third and one-half full levels.

Waste material 14 to be packaged is directed from processing or temporary storage apparatus not shown into bag 20 through a second pipeline 28 as illustrated in FIG. 3 after supply of an appropriate quantity of liquid. The waste particles mix into the liquid by gravitational settling. Displacement of liquid by the solid particles raises the level of material in the barrel 12, including the liquid material in the space 24 between bag 20 and barrel 12, to provide a layer of non-radioactive material between the radioactive particulate in bag 20 and sides of barrel 12. The waste particles become coated as they settle down into the liquid and thus form a packed mass of radioactive particles. Each particle is surrounded by a coating of liquid material that also fills space between settled particles as illustrated in Applicant's FIG. 5.

Figures 5, 6:
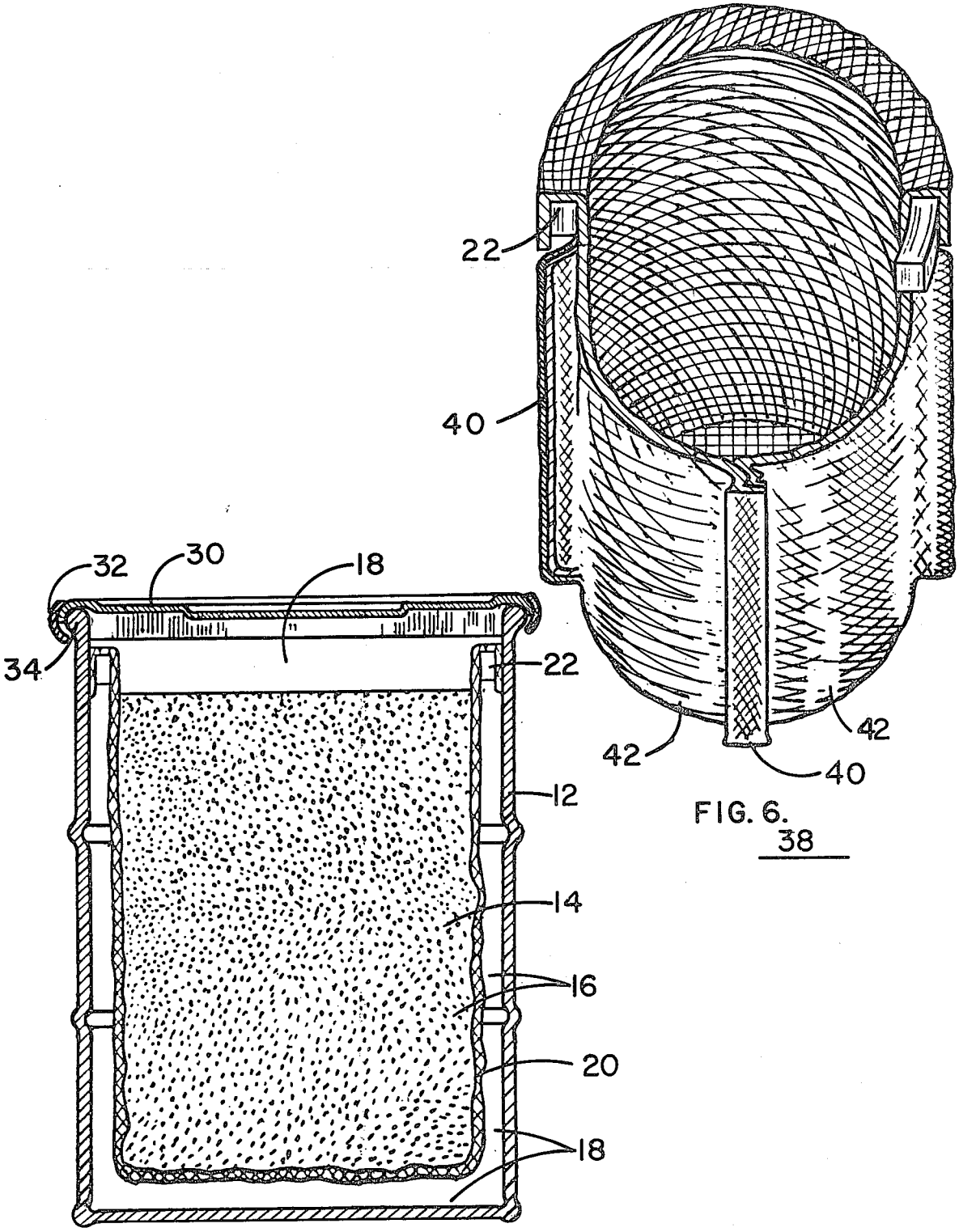
FIG. 5 is a cross-sectional view of a barrel filled with an immobilized mixture of radioactive particulate surrounded by a protective layer of non-radioactive material.
FIG. 6 is a perspective illustration of an alternate fabric bag having pleated sections that keep the bag from being flattened against the walls of a barrel container.

As is also illustrated in FIG. 5, the settling of the solid particulate into the liquid leaves a layer of substantially pure liquid material 16 above the packed mixture of coated waste particles. The thickness of this top layer is determined by the ability of the liquid to contain foreign matter, and the relative quantities of liquid used and waste added. In practice, these quantities are selected so that the waste material will not quite "fill" the liquid, but will instead leave a top layer of liquid 16 about as thick as the portion of the layer 18 between the sides of bag 20 and barrel 12.

Figure 4:
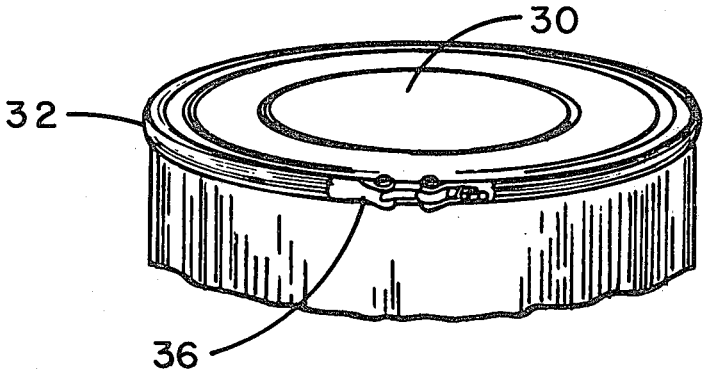
FIG. 4 is a perspective view of the top of a filled, closed container drum.

The liquid 16 is then solidified to immobilize waste particles 14 and convert the layer 18 of liquid material surrounding the waste mixture to a non-leachable containment barrier completely surrounding or containing a homogeneous mass of encapsulated radioactive waste material. The containment barrier 18 is contiguous with the solidified mass, but non-homogeneous with the material contained within that barrier by the specific inclusion of radioactive material because of the physical separation provided by the tight mesh weave of bag 20. After barrel 12 is filled, it is closed with a conventional cover 30, and closure ring 32 as illustrated in FIG. 4. Cover 30 fits partially over the lip 34 (FIG. 5) of barrel 12. Ring 32 fits over both the edge of cover 30 and lid 34 of barrel 12 such that tightening of closure pin 36 of ring 32 holds the cover 30 securely to the barrel.

The mass within barrel 12 is then allowed to solidify, as for example by cooling from an elevated temperature at which immobilization material is a liquid, to normal environmental temperatures at which the immobilization material is a solid. Remote automatic packaging apparatus for closing this type of barrel container is known and should be used along with other remote handling apparatus for providing further handling and transportation of the filled containers to a burial or other storage site, because of the radioactive nature of the contained material.

The packaging process illustrated by FIGS. 1 through 5 can be used to package many different kinds of hazardous materials. The specific combination of materials used for bag 20 and immobilization material 16 in each particular application will depend upon such things as cost, the general availability of different materials at different times, and the nature of the material being packaged. But, to provide specific examples of packaging materials, nylon, cotton, polyethylene, polyester and polypropylene fabrics are good materials to use for bag 20. And preferred immobilization materials include polyethylene, wax, thermal setting petroleum-base organic materials such as asphalt or bitumin, that melt at a relatively low temperature, between say 200° and 500° F, similar thermal setting plastics and resins, and any compounds solidified by a catalytic interaction that does not affect either the bag or waste materials, and in which the waste materials are insoluble in the solidification material.

All of these bag materials are strong, porous, inexpensive, durable, and not susceptible to being destroyed by chemical interaction with either the solidifcation or waste materials. They are also capable of withstanding the temperatures required to melt thermal setting solidification materials. These solidification materials are all also readily available, inexpensive, and insoluble in water and thus capable of providing protection against dispersion of radioactive material by ground water leaching if package 10 is buried and barrel 12 is cracked. They also do not dissolve either the radioactive waste or other toxic materials likely to be packaged according to this invention, or the fabric bag materials listed above, and thus will not carry toxic materials outside the boundaries of bag 20. And, the relatively low melting temperatures of the thermal setting materials permit ready conversion to a liquid and provision of that liquid with a viscosity that allows the waste particles to settle down through that material at a reasonable rate.

It is believed that this invention will probably be used most often to package solid particulate radioactive wastes from water treatment systems. Such systems generally provide an output of sand-like particles having densities of about 1.1 to 1.8 g/cc. Embodiments of the immobilization materials listed above having densities around approximately 0.9 to 1.0 g/cc. are preferred for packaging these wastes to facilitate settling of wastes into the liquid as illustrated in FIGS. 3 and 5.

One advantage of this invention is that it can be readily modified and adapted for different specific situations. For example, the toxic and solidification materials can be mixed by mechanical stirring, as well as by gravity as shown. They can also be premixed instead of in the final storage container. A portion of a premixed solidification material will flow through the porous bag material to form a protective layer similar to layer 18. But, the bag does hold the toxic particulate material internal to its structure, along with residual premixed liquid. Solidification forms the same end product as that shown by the illustrated embodiment, having a protective layer composed of essentially pure immobilization material. This invention can therefore be used equally well with both processing apparatus in which it is desirable to withhold the immobilization material from the toxic material until final packaging, and processing apparatus in which it is desirable to mix the two materials for some reason before processing is completed.

As other examples of modifications that can be used in different applications of this invention, multiple bags can be used to improve the structural characteristics of the protective layer or skin and thereby decrease the likelihood of damage to the solidified mass in the event of mechanical rupture or penetration of the barrel or other outer container during the handling and transport process. And, special support webs and other structures can be used, if needed, to hold the one or more bags slightly away from the sides and bottom of the container drum and/or away from each other to effectively control the structure and thickness of the protective outer skin. If the materials being packaged in a particular application tend to press the bag against the barrel or other container so that a protective layer of the desired thickness will not form, a bag 38 (FIG. 6) folded to have pleats or ribs 40 that act as spacer members that hold portions 42 of bag 38 away from either the outer barrel or other bags, and thus directly control the wall thickness of the surface area skin, can be used. The fabricated pleats or ribs are porous, and thus also fill with liquid. After solidification they enhance the structural characteristics of the skin.

Closed head container drums, which are sealed by simply capping a small fill opening, can be used in place of the open headed drum shown in the drawings to simplify closure of a container holding radioactive material. When closed head drums are used, a bag can be prefolded or rolled into an appropriate size and shape for insertion through the small cap opening to such a drum. It would then be inserted into the drum, fastened to the cap opening, and expanded. If this bag insertion is considered too time-consuming, an open headed drum can be fitted with a bag as shown and then covered before addition of any material with a lid having a small fill cap. This invention also can be used to package particles and objects substantially larger than the granular sizes illustrated. And, containers other than barrels and porous liners not necessarily in the form of a bag can also be used.

These, and numerous other adaptations and modifications can be used in application of this invention.

Therefore, what is claimed is:

1. A package containing toxic solid material comprising:

outer wall means;

a layer of a material that is impervious to the solid toxic material but porous to a liquified immobilization material spaced at a predetermined distance from said wall means and substantially encompassing a preselected area within the package;

solid toxic material confined within said encompassed area by said impervious material; and a liquefiable immobilization material that will penetrate said layer when liquefied disposed both within said encompassed area in mixture with said solid toxic material, and also between said layer and said wall means to isolate said layer and said toxic material from said wall means.

2. The package of claim 1 in which said porous material comprises a bag that is slightly smaller than said outer wall means and is formed from a material having a sufficiently tight mesh to prevent penetration by said solid toxic material.

3. The package of claim 1 in which said porous material is selected from the group consisting of either nylon, cotton, polyethylene, polyester, or polypropylene fabric.

4. The package of claim 1 in which said porous material comprises a fabric that is gathered at spaced intervals to contact said outer wall means and thereby hold the portions of said fabric between said gatherings away from said outer wall means.

5. The package of claim 1 in which the immobilization material disposed between said area encompassed by said porous material and said outer wall means, covers the entire mixture of immobilization and toxic materials disposed within said encompassed area, and thereby completely isolates said toxic material from said container means.

6. The package of claim 1 in which said solid toxic material comprises particulate radioactive waste, and said immobilization material is slightly less dense than said radioactive particulate.

7. A method of packaging solid toxic material comprising the steps of:

positioning at least one layer of a porous material that is impervious to the solid toxic material to be packaged a predetermined distance from the inside surface of a container, said layer substantially encompassing a preselected area within said container;

directing both a solid toxic material and a non-toxic liquid material into said encompassed area, said porous material acting as a barrier to said solid toxic material, said liquid material permeating said porous material to become disposed both within said encompassed area in mixture with said toxic material, and also between said porous material and said container; and solidifying said liquid material to form a solid package in which said toxic material is both immobilized and isolated from the walls of said container.

8. The packaging method of claim 7 in which said said step of positioning at least one layer of a porous material a predetermined distance from the inside surface of said container comprises inserting into said container a bag that is slightly smaller than said container and is formed from a material that has a sufficiently tight mesh to prevent penetration by said solid toxic material.

9. The packaging method of claim 7 in which said step of directing toxic and non-toxic materials into said area comprises filling said container with a low-radiation level particulate material and a non-radioactive liquid that has a sufficiently low viscosity to mix with said radioactive particulate and also penetrate said porous material.

10. The packaging method of claim 7 in which:

said step of directing material into said container comprises directing a toxic solid and a non-toxic liquid that is slightly less dense than said toxic material into said container; and the method further includes the step of allowing sufficient time before said solidifying of said liquid for said toxic material to settle down into said liquid and become covered by a top layer of non-toxic material.

* * * * *